US009044655B1

(12) United States Patent
Hanson

(10) Patent No.: US 9,044,655 B1
(45) Date of Patent: Jun. 2, 2015

(54) GOLF PUTTER

(71) Applicant: Timothy J. Hanson, West Bend, WI (US)

(72) Inventor: Timothy J. Hanson, West Bend, WI (US)

( * ) Notice: Subject to any disclaimer, the term of this patent is extended or adjusted under 35 U.S.C. 154(b) by 3 days.

(21) Appl. No.: 14/156,983

(22) Filed: Jan. 16, 2014

Related U.S. Application Data

(63) Continuation-in-part of application No. 13/621,302, filed on Sep. 17, 2012, now abandoned.

(51) Int. Cl.

| | |
|---|---|
| ***A63B 69/36*** | (2006.01) |
| ***A63B 53/04*** | (2006.01) |
| ***A63B 53/06*** | (2006.01) |
| ***A63B 53/00*** | (2006.01) |

(52) U.S. Cl.
CPC ..... *A63B 53/0487* (2013.01); *A63B 53/007* (2013.01); *A63B 69/3685* (2013.01); *A63B 2053/0441* (2013.01); *A63B 53/065* (2013.01); *A63B 2053/0433* (2013.01); *A63B 2053/0445* (2013.01); *A63B 2053/0491* (2013.01)

(58) Field of Classification Search
CPC ..... A63B 53/0487; A63B 53/065; A63B 2053/0441; A63B 53/007; A63B 2053/0433; A63B 2053/0445; A63B 2053/0491; A63B 69/3685
USPC ..... 473/330, 251–256, 340, 341, 344, 334, 473/335, 338, 331, 349
See application file for complete search history.

(56) References Cited

U.S. PATENT DOCUMENTS

| | | | | |
|---|---|---|---|---|
| 1,509,429 | A * | 9/1924 | Hillerich | 473/342 |
| 1,525,137 | A | 2/1925 | Lawton | |
| D138,380 | S * | 7/1944 | Myers | D21/743 |
| 2,472,312 | A * | 6/1949 | Parrish | 473/330 |
| 2,936,248 | A * | 5/1960 | Marciniak | 427/297 |
| 3,692,306 | A * | 9/1972 | Glover | 473/306 |
| 3,881,733 | A * | 5/1975 | Csernits | 473/330 |
| 3,954,265 | A * | 5/1976 | Taylor | 473/252 |
| 4,162,074 | A * | 7/1979 | Thomson | 473/330 |
| 4,741,535 | A * | 5/1988 | Leonhardt | 473/252 |
| 4,872,684 | A | 10/1989 | Dippel | |
| 4,934,702 | A * | 6/1990 | Serizawa | 473/251 |
| 5,303,923 | A * | 4/1994 | Garcia | 473/330 |
| 5,509,660 | A * | 4/1996 | Elmer | 473/288 |
| 5,601,499 | A * | 2/1997 | Segaline | 473/313 |
| 5,863,262 | A * | 1/1999 | Donofrio | 473/330 |
| 6,102,813 | A * | 8/2000 | Dill | 473/305 |
| 6,176,791 | B1 * | 1/2001 | Wright | 473/252 |
| 6,554,721 | B1 | 4/2003 | Woodward et al. | |
| 6,634,956 | B1 * | 10/2003 | Pegg | 473/251 |
| 7,134,970 | B2 * | 11/2006 | Lindsay | 473/313 |
| 7,156,752 | B1 * | 1/2007 | Bennett | 473/334 |
| 7,169,058 | B1 | 1/2007 | Fagan | |
| 7,326,121 | B2 * | 2/2008 | Roake | 473/251 |
| 2006/0079343 | A1 * | 4/2006 | Zamora | 473/251 |
| 2010/0222153 | A1 * | 9/2010 | Treadwell | 473/251 |

* cited by examiner

*Primary Examiner* — Sebastiano Passaniti
(74) *Attorney, Agent, or Firm* — Donald J. Ersler

(57) ABSTRACT

A golf putter includes a putter head, a shaft and hand grip. The putter head includes a lower curved striking face and a substantially straight upper striking face. The straight striking face extends upward vertically from an upper end of the curved striking face. A height as measured from a bottom surface to a junction of the straight striking face and the curved striking face is at least one half the outer diameter of a regulation golf ball. An alignment striking line is created on a top and middle of the putter head. The hand grip is attached to one end of the shaft. The other end of the shaft is inserted into a top of the putter head. An impact plate is attached to a bottom and front of the putter head. A plurality of horizontal grooves are formed in the impact plate.

17 Claims, 5 Drawing Sheets

GOLF PUTTER

CROSS-REFERENCES TO RELATED APPLICATIONS

This application claims priority from U.S. Non-Provisional application Ser. No. 13/621,302, filed on Sep. 17, 2012, which claims priority from provisional application No. 61/692,755 filed on Aug. 24, 2012.

BACKGROUND OF THE INVENTION

1. Field of the Invention

The present invention relates generally to golfing and more specifically to a golf putter, which the causes the golf ball to have top spin or over spin, thus preventing lifting during a putting swing.

2. Discussion of the Prior Art

U.S. Pat. No. 1,525,137 to Lawton discloses a golf club. U.S. Pat. No. 4,872,684 to Dippel discloses a golf putter. U.S. Pat. No. 6,554,721 to Woodward et al. discloses a golf club head. U.S. Pat. No. 7,169,058 to Fagan discloses a golf putter head having multiple striking surfaces. Accordingly, the prior art fails to disclose a golf putter with a substantially straight upper striking face extending upward from a curved lower striking face. The substantially straight upper striking face allows an alignment striking line to be placed on a top of the putter head. Further, the prior art fails to disclose a striking face with either sandpaper or grit applied to the striking face thereof.

Accordingly, there is a clearly felt need in the art for a golf putter, which includes a curved lower striking face and a substantially straight upper striking face; either sandpaper or grit applied to striking face; and causes the golf ball to have top spin or over spin, thus preventing lifting during a putting swing.

SUMMARY OF THE INVENTION

The present invention provides a golf putter, which includes a curved lower striking face and a substantially straight upper striking face. The golf putter includes a putter head, a shaft and hand grip. The putter head includes a lower curved striking face and a substantially straight upper striking face. It is preferable that the curved striking face is a single radius, but the radius may be non-constant. The straight striking face extends upward from an upper end of the curved striking face. A bottom surface of the putter head extends from a lower end of the curved striking face. The bottom surface of the putter head is preferably substantially perpendicular to the straight striking face. A height as measured from the bottom surface to the junction of the straight striking face and the curved striking face is at least one half the outer diameter of a regulation golf ball.

The putter head may be fabricated from any suitable material, such as wood, plastic, synthetic material, metal or any other suitable material. The putter head may be hollowed-out to reduce weight. Alternatively, a weight may be inserted into the hollowed-out area to increase weight. A piece of sandpaper may be secured to the straight and curved striking faces with any suitable method.

Alternatively, grit may be glued directly to the straight and curved striking faces. An alignment striking line is created on a top and middle of the putter head for alignment with a golf ball, above the straight striking face. A pair of parallel alignment lines are created on each end of the putter head. The pair of parallel alignment lines are parallel with the alignment striking line.

Alternatively, an impact plate may be attached to a bottom and front of the putter head with any suitable method, such as a plurality of fasteners. The impact plate includes a front portion, a curved portion and a bottom portion. A plurality of horizontal grooves are formed in the front portion to induce back spin on a golf ball.

The hand grip is attached to one end of the shaft. Shafts for putters are well known in the art and need not be explained in detail. The other end of the shaft is inserted into a shaft hole formed in a top of the putter head. The shaft hole is preferably dissected by the alignment striking line. A centerline of the shaft hole preferably forms an angle of 79 degrees with the top of the putter head.

Accordingly, it is an object of the present invention to provide a golf putter, which includes a curved lower striking face and a substantially straight upper striking face.

It is a further object of the present invention to provide a golf putter, which includes a piece of sandpaper or grit applied to the striking face.

Finally, it is another object of the present invention to provide a golf putter, which causes the golf ball to have top spin or over spin, thus preventing lifting during a putting swing.

These and additional objects, advantages, features and benefits of the present invention will become apparent from the following specification.

DETAILED DESCRIPTION OF THE PREFERRED EMBODIMENTS

Figure 1:
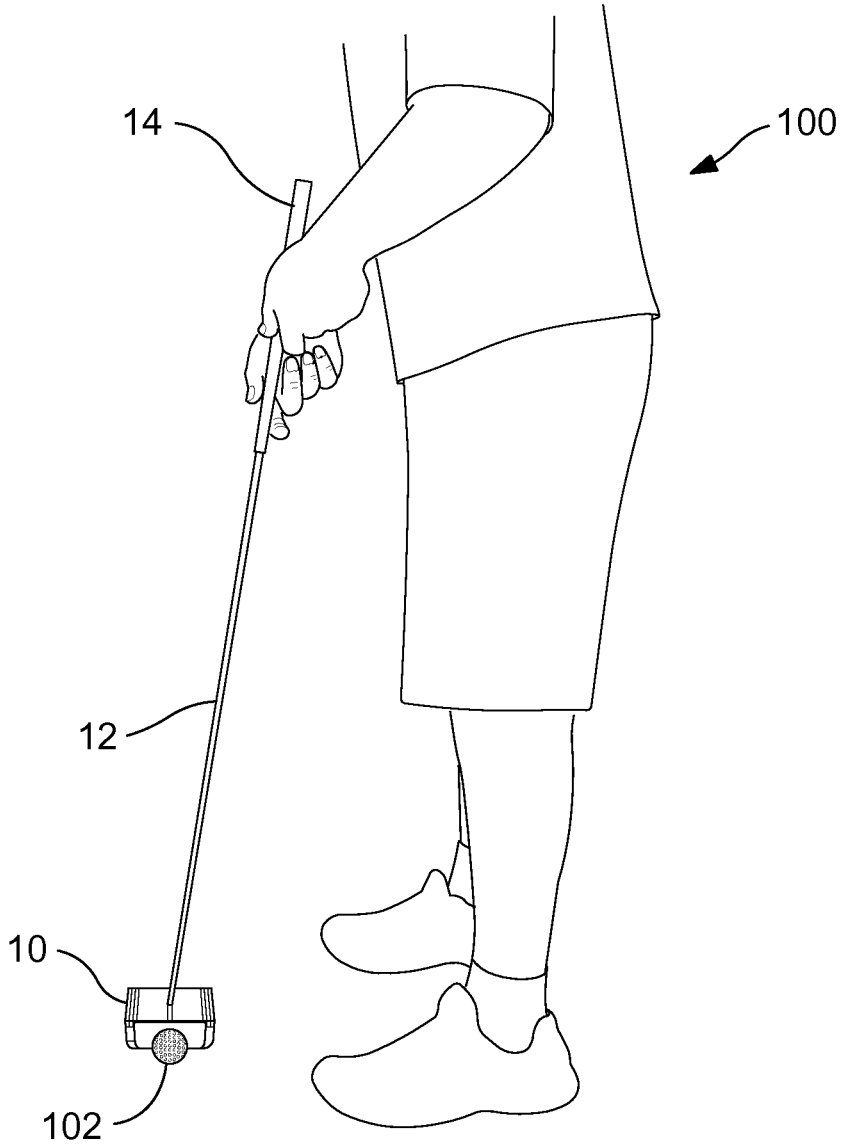
FIG. 1 is a perspective view of a golf putter being held by a golfer in accordance with the present invention.
Figure 1A:
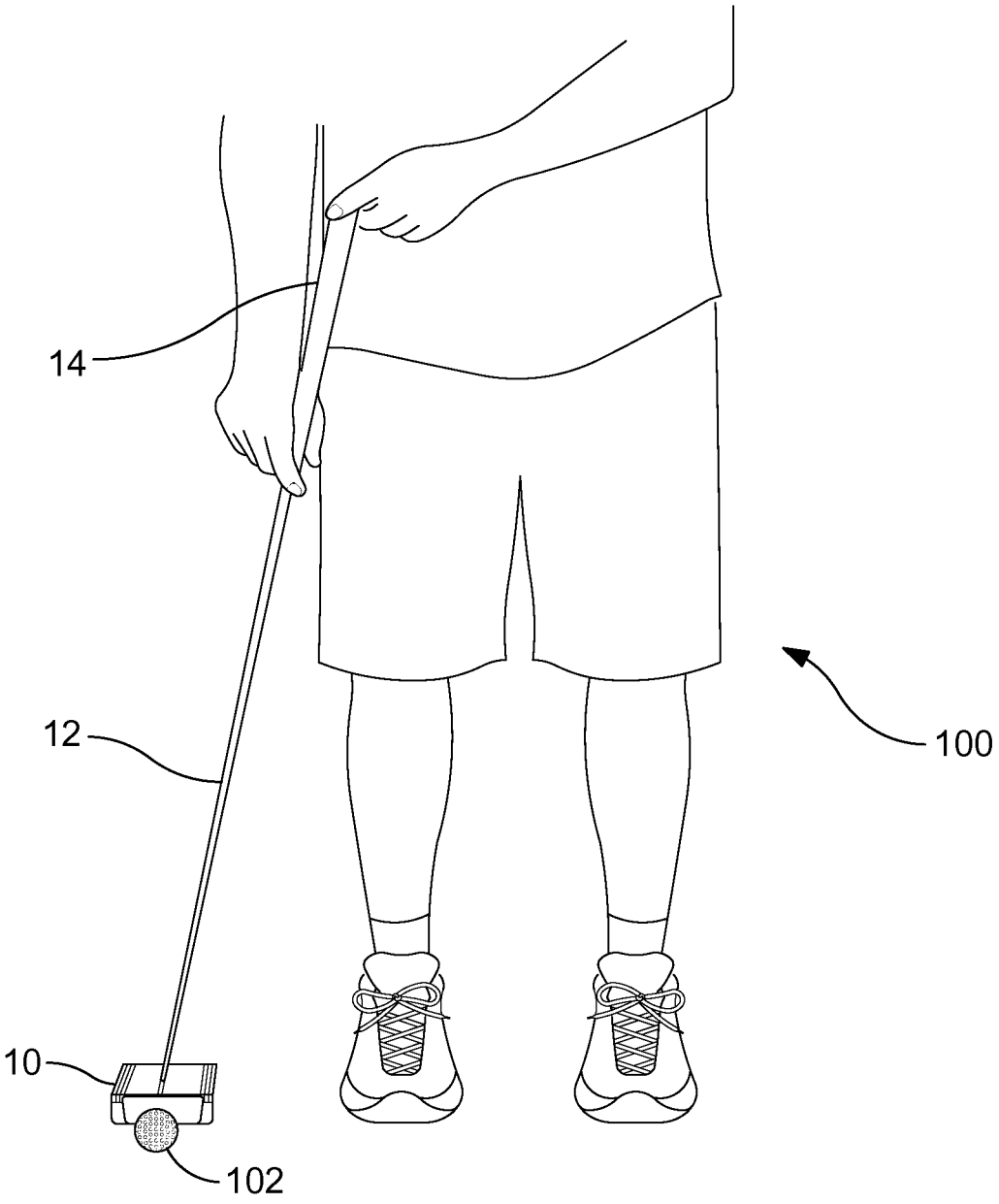
FIG. 1*a* is a perspective view of a golf putter being held by a golfer in a "side saddle" position in accordance with the present invention.
Figure 2:
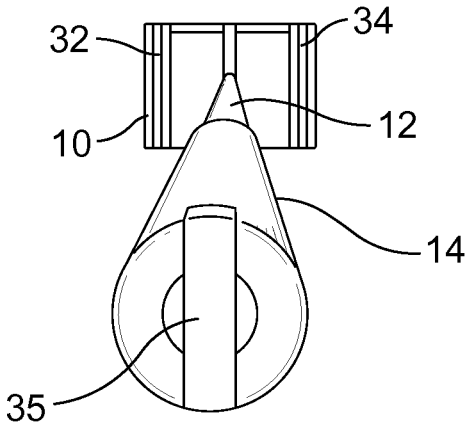
FIG. 2 is a top perspective view of a golf putter in accordance with the present invention.
Figure 3:
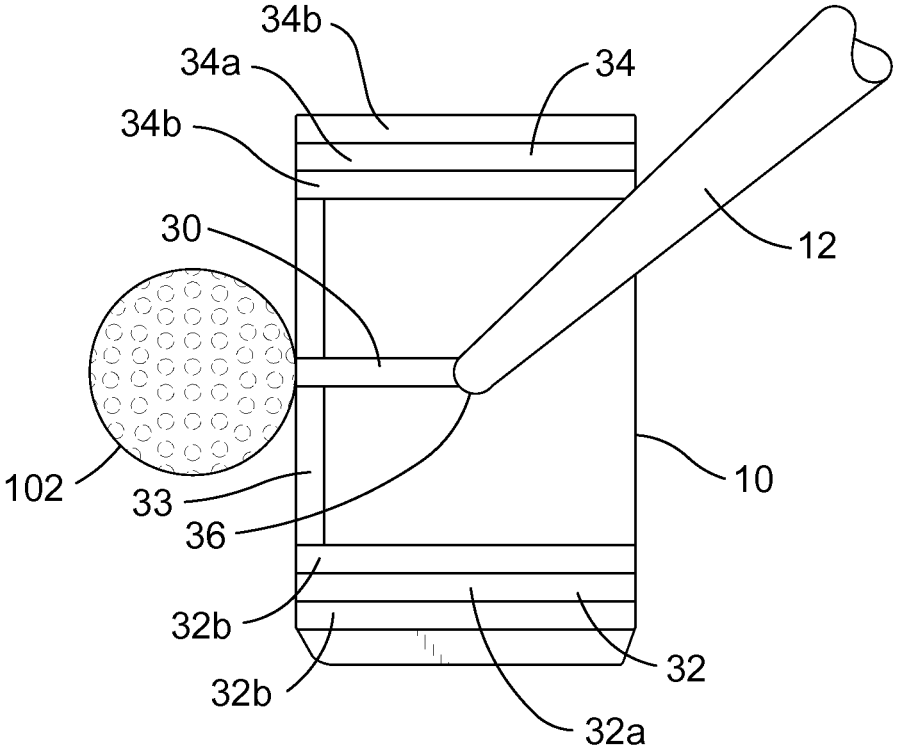
FIG. 3 is a top perspective view of a golf ball in front of a putter head of a golf putter in accordance with the present invention.
Figure 4:
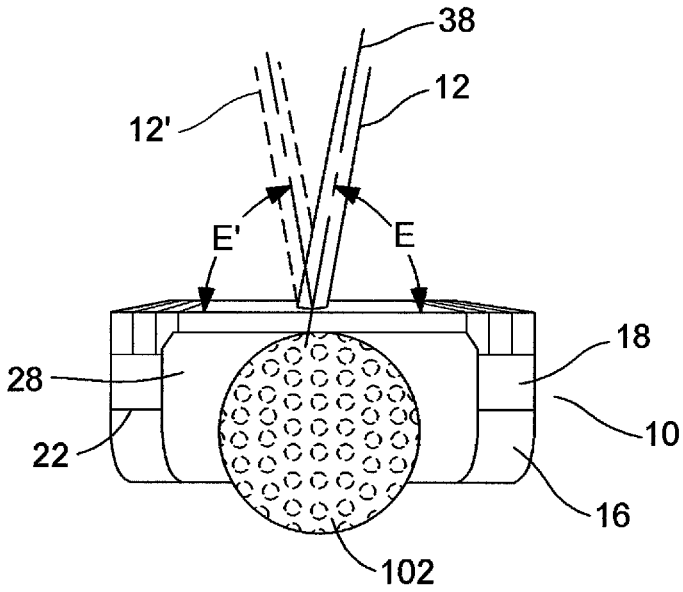
FIG. 4 is a front view of a golf ball in front of a putter head of a golf putter in accordance with the present invention.
Figure 5:
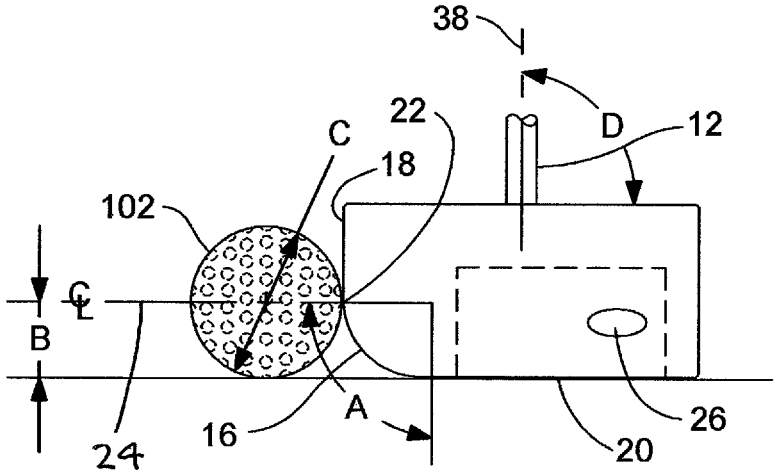
FIG. 5 is an end view of a golf ball and a putter head of a golf putter in accordance with the present invention.

With reference now to the drawings, and particularly to FIG. 1, there is shown a perspective view of a golf putter 1 being held by a golfer 100. With reference to FIG. 1*a*, the golf putter 1 is held by the golfer 100 in a "side saddle" position. With reference to FIGS. 2-5, the golf putter 1 includes a putter head 10, a shaft 12 and hand grip 14. The putter head 10 includes a lower curved striking face 16 and a substantially straight upper striking face 18. It is preferable that the curved striking face 16 is a single radius, but the radius may be non-constant. The curved striking face 16 has an included angle "A" of substantially 90 degrees. The straight striking face 18 preferably extends upward, substantially vertically from an upper end of the curved striking face 16. A bottom surface 20 of the putter head 10 preferably extends substantially horizontally from a lower end of the curved striking face 16. The bottom surface 20 of the putter head 10 is preferably substantially perpendicular to the straight striking face 18. A height "B" as measured from the bottom surface 20 to a junction 22 of the straight striking face 18 and the curved striking face 16 is at least one half the outer diameter "C" of a regulation golf ball 102. The height "B" is also a horizontal centerline 24 of the golf ball 102. The height "B" causes the golf ball 102 to be struck at or above its center of gravity.

The putter head 10 may be fabricated from any suitable material, such as wood, plastic, synthetic material, metal or any other suitable material. A hollowed-out area 26 may be formed in the putter head 10 to reduce weight. Alternatively, a weight may be inserted into the hollowed-out area 26 to increase weight. A piece of sandpaper 28 may be secured to the curved and straight striking faces 16, 18 with any suitable method. Alternatively, grit may be glued directly to the curved and straight striking faces, 16, 18. An alignment striking line 30 is created on a top and middle of the putter head 10 for alignment with the golf ball 102, above the straight striking face 18. A pair of parallel alignment lines 32, 34 are created on each end of the putter head 10. The pair of parallel alignment lines 32, 34 are parallel with the alignment striking line 30. The alignment line 32 preferably includes a white colored center line 32*a* and two outer black lines 32*b*. The alignment line 34 preferably includes a white colored center line 34*a* and two outer black lines 34*b*. A black colored front face line 33 is preferably formed on top of the putter head 10 and at a front thereof.

The hand grip 14 is attached to one end of the shaft 12. A grip alignment line 35 is preferably formed on an end of the hand grip 14, which is parallel with the alignment lines 30, 32, 34. Shafts for putters are well known in the art and need not be explained in detail. The other end of the shaft 12 is inserted into a shaft hole 36 formed in a top of the putter head 10. The shaft hole 36 is preferably dissected by the alignment striking line 30. A centerline 38 of the shaft hole 36 is substantially parallel to the straight striking face 18 as defined by angle D. Angle D has a value of substantially 90 degrees. A centerline 38 of the shaft hole 36 preferably forms an angle "E" with the top of the putter head 10. The angle E has a preferable value of 79 degrees. A left handed golf putter 1 with a shaft 12' may be created by forming the shaft hole 36 at an angle E' with the top of the putter head 10.

Figure 6:
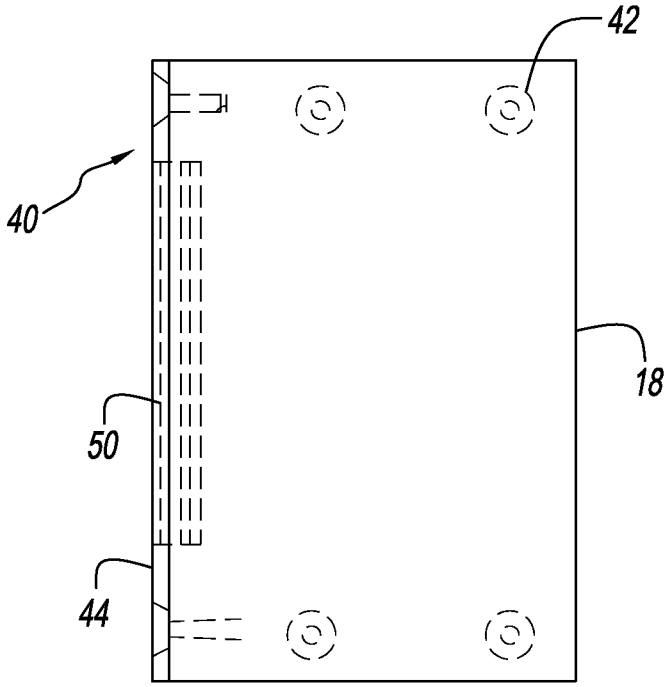
FIG. 6 is a top view of a putter head with an impact plate attached thereto of a golf putter in accordance with the present invention.
Figure 7:
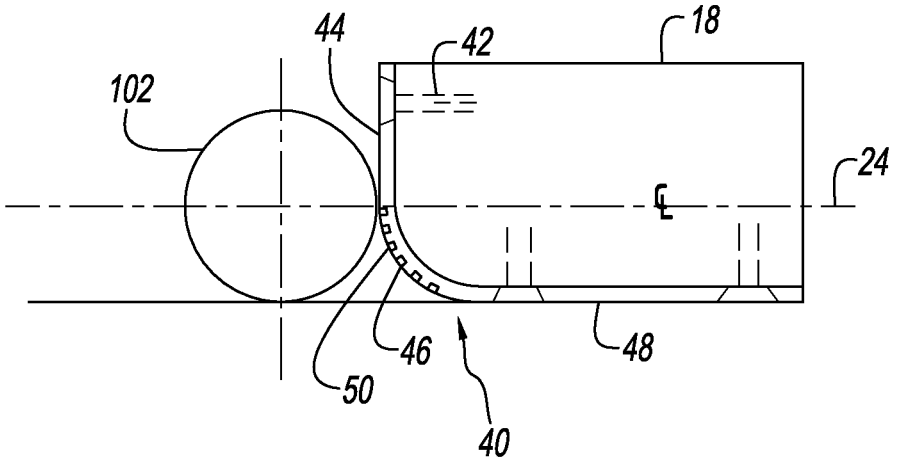
FIG. 7 is an end view of a putter head with an impact plate attached thereto of a golf putter in accordance with the present invention.

With reference to FIGS. 6-7, an impact plate 40 is attached to a bottom and front of the putter head 18 with a plurality of fasteners 42. However, the impact plate 40 may be attached to the putter head 18 with any other suitable method, such as adhesive. The impact plate 40 is preferably fabricated from stainless steel, but other suitable materials may also be used, such as titanium. The impact plate 40 includes a front portion 44, a curved portion 46 and a bottom portion 48. A plurality of horizontal grooves 50 are formed in the curved portion 44 to induce back spin on a golf ball 102. The plurality of horizontal grooves 50 preferably start at a top of the curved portion 46 and continue to substantially a bottom of the curved portion 46. The plurality of horizontal grooves 50 extend across substantially all of a width of the putter head 18. The following dimensions are given by way of example and not by way of limitation, each horizontal groove 50 is preferably 0.03 inches wide×0.03 inches deep, but other sizes may also be used. A preferable space of 0.10 inches is created between two adjacent horizontal grooves 50.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A golf putter comprising:

a putter head having a front surface, a bottom surface and a top surface, a lower curved striking face and an upper striking face are formed on said front surface, said lower curved striking face includes an upper end and a lower end, said upper striking face extends substantially vertically from said upper end of said lower curved striking face, said bottom surface extends substantially horizontally from said lower end of said curved striking face, a radius of said lower curved striking face is defined from a bottom surface of said putter head to a height that is equal to about one half of a diameter of a golf ball;

an alignment striking line is created on said top surface and a middle of said putter head above said upper striking face;

a pair of parallel alignment lines are created on each end of said putter head;

a front face line is formed on said top surface and said front surface; and a shaft having a first end and a second end, said first end being inserted into a top of said putter head.

2. The golf putter of claim 1 wherein:

said curved striking face has an included angle of substantially 90 degrees.

3. The golf putter of claim 1 wherein:

said curved striking face has a non-constant radius.

4. The golf putter of claim 1 wherein:

said putter head is fabricated from at least one of wood, a plastic material, a synthetic material and metal.

5. The golf putter of claim 1, further comprising:

an impact plate is attached to a bottom and front of said putter head.

6. The golf putter of claim 5 wherein:

said impact plate includes a front portion, a curved portion and a bottom portion, said impact plate is attached to a bottom and front of said putter head, a plurality of horizontal grooves are formed in said curved portion.

7. The golf putter of claim 1, further comprising:

a piece of sandpaper is attached to said straight striking face and said curved striking face.

8. The golf putter of claim 1 wherein:

a hollowed-out area is formed in a bottom of said putter head to reduce weight thereof.

9. A golf putter comprising:

a putter head having a front surface, a bottom surface and a top surface, a lower curved striking face and an upper striking face are formed on said front surface, said lower curved striking face includes an upper end and a lower end, said upper striking face extends substantially vertically from said upper end of said lower curved striking face, a height of a junction between said curved striking face and said straight striking face has a dimension which is at least one half of an outer diameter of a golf ball, said bottom surface extends substantially horizontally from said lower end of said curved striking face, a radius of said lower curved striking face is defined from a bottom surface of said putter head to said junction, a radius of said lower curved striking face is equal to about a radius of a golf ball;

an alignment striking line is created on said top surface and a middle of said putter head above said upper striking face;

a pair of parallel alignment lines are created on each end of said putter head;

a front face line is formed on said top surface and said front surface; and a shaft having a first end and a second end, said first end being inserted into a top of said putter head.

10. The golf putter of claim 9 wherein:

said curved striking face has an included angle of substantially 90 degrees.

11. The golf putter of claim 9 wherein:

said putter head is fabricated from at least one of wood, a plastic material, a synthetic material and metal.

12. The golf putter of claim 9, further comprising:

an impact plate is attached to a bottom and front of said putter head.

13. The golf putter of claim 12 wherein:

said impact plate includes a front portion, a curved portion and a bottom portion, said impact plate is attached to a bottom and front of said putter head, a plurality of horizontal grooves are formed in said curved portion.

14. The golf putter of claim 9 wherein:

a hollowed-out area is formed in a bottom of said putter head to reduce weight thereof.

15. A golf putter comprising:

a putter head having a front surface, a bottom surface and a top surface, a lower curved striking face and an upper striking face are formed on said front surface, said lower curved striking face includes an upper end and a lower end, said upper striking face extends vertically from said upper end of said lower curved striking face, a height of a junction between said curved striking face and said straight striking face has a dimension which is at least one half of an outer diameter of a golf ball, said bottom surface extends horizontally from said lower end of said curved striking face, a radius of said lower curved striking face is defined from a bottom surface of said putter head to said junction, a radius of said lower curved striking face is equal to about a radius of a golf ball;

an alignment striking line is created on said top surface and a middle of said putter head above said upper striking face;

a pair of parallel alignment lines are created on each end of said putter head;

a front face line is formed on said top surface and said front surface; and a shaft having a first end and a second end, said first end being inserted into a top of said putter head.

16. The golf putter of claim 15, further comprising:

an impact plate is attached to a bottom and front of said putter head.

17. The golf putter of claim 15 wherein:

a hollowed-out area is formed in a bottom of said putter head to reduce weight thereof.

* * * * *